US005244364A

United States Patent [19]

Laco et al.

[11] Patent Number: 5,244,364

[45] Date of Patent: Sep. 14, 1993

[54] PUMPING UNIT

[75] Inventors: Eligio Laco; Enzo Monti, both of Reggio Emilia, Italy

[73] Assignee: Leuco, S.p.A., Reggio Emilia, Italy

[21] Appl. No.: 731,812

[22] Filed: Jul. 17, 1991

[30] Foreign Application Priority Data

Jul. 20, 1990 [IT] Italy ..... 34843 B/90

[51] Int. Cl.[5] ..... F04B 21/02

[52] U.S. Cl. ..... 417/534; 417/540

[58] Field of Search ..... 417/540, 534

[56] References Cited

U.S. PATENT DOCUMENTS

| | | | |
|---|---|---|---|
| 1,240,712 | 9/1917 | Hamilton | 417/534 |
| 4,512,188 | 4/1985 | Erickson | 417/540 |
| 4,594,059 | 6/1986 | Becker | 417/540 |
| 4,734,011 | 3/1988 | Hall | 417/540 |
| 4,842,492 | 6/1989 | Gannaway | 417/540 |
| 4,867,653 | 9/1989 | Mills et al. | 417/360 |
| 5,036,662 | 8/1991 | Knowlton | 417/540 |
| 5,051,074 | 9/1991 | Cowan | 417/534 X |
| 5,074,767 | 12/1991 | Gerlach et al. | 417/500 X |
| 5,076,769 | 12/1991 | Shao | 417/534 |
| 5,129,427 | 7/1992 | White et al. | 417/540 |

*Primary Examiner*—Richard A. Bertsch
*Assistant Examiner*—Alfred Basichas
*Attorney, Agent, or Firm*—Zarley, McKee, Thomte, Voorhees & Sease

[57] ABSTRACT

A pumping unit, particularly for waterblasters and similar equipments, comprising the pump, the control unit, and the pressure damping device to form a single body, although they can be separated from each other. The pump has one double-acting plunger.

7 Claims, 2 Drawing Sheets

PUMPING UNIT

BACKGROUND OF THE INVENTION

This invention concerns piston pumps, and more particularly, those having a delivery ranging from some liters/minute up to several liters/minute. Such pumps are particularly used in the so-called waterblasters, i.e., those equipments which produce a jet water under pressure, possibly mixed with chemical detergents, to be directed on the object to be washed through a lance.

The above-mentioned pumps are of the fixed flow type and usually have two or three ceramic plungers.

The connecting rod/crankshaft assembly is usually made of anti-friction material. Each piston is provided with two automatic valves, one for the suction, and one for the delivery. Usually the pumps marketed are provided with some accessories, particularly, a control unit of the pump, separate from the latter.

This control unit connected to the delivery port of the pump enables to increase or decrease the flow from the lance, which is connected to the control unit by a flexible hose. The variation of the flow is obtained by deviating to a return line a part of the flow entering the control unit.

The control unit also enables to interrupt, while the pumps are working, the flow coming out from the lance by deviating it completely to the return line.

The above control unit is made in such a way that when closing the flow coming out from the lance, not only does the flow go to the return line, but the pressure is strongly reduced (for example, from 1500–3000 psi to 60–70 psi), the pump, therefore, works no-load.

There are pumps of this type, having more than two plungers, even opposed.

Furthermore, there are pumps incorporating the above-mentioned control unit so as to obtain an assembly (pump plus control unit) to simplify the assembling job.

The known pumping units above all those with two plungers are provided with a pressure damping device on the pressure line. This pressure damping device is an independent component of the pump and connected to it by a high-pressure hose, and its function is to make uniform the outlet pressure and avoid cyclical peaks. This pressure damping device also has the function of a pressure accumulator. It therefore gives back the energy received during the pressure peak.

As this pressure damping device is independent from the pump, specialized manpower is required to mount it on waterblasters or similar equipment and to connect it to the pump pressure line, the effects of which on costs are significant.

There are, however, some pumping units of the above type with two or three plunger pumps that also incorporate the pressure damper and, consequently, an easier assembling job.

In such a way besides the time saving due to the fact of installing just one unit, there is also the advantage of eliminating all the high-pressure connectors among the pump, the control unit and pressure damper, and a significant time saving on installation is therefore obtained. Moreover, all possible leakages due to connectors are eliminated.

SUMMARY OF THE INVENTION

The aim of this invention is to obtain a pumping unit incorporating in a single body, the pump, the control unit and the pressure damper, extremely simple and compact, with reduced dimensions in comparison with the known pumping units, reliable and with low production and assembly costs.

The above aim is attained thanks to our pumping unit where the pump, the control unit and pressure damper make up a single body, although they are separate, characterized by a pump with one double-acting plunger. The pump with one double-acting plunger allows only one series of plunger seals, one connecting rod, one plunger pin, one crankshaft with one cam and one crankshaft seal. The result is a pump structure particularly simple, compact and with reduced dimensions.

The combination of a single, double-acting piston feature with the feature of incorporating both control unit and pressure damping device in the pumping unit allows to obtain a small-sized, simple, compact and inexpensive pumping unit.

As already mentioned, the fact of having a single and compact pumping unit to be mounted on the waterblaster contributes to reduce further the overall dimensions of the waterblaster itself. Once the pumping unit has been installed in the waterblaster or in a similar equipment, the lance will have to be connected to the pumping unit by a flexible hose.

The invention will be more easily comprehensible from the following description of the pumping unit.

DESCRIPTION OF PREFERRED EMBODIMENT

Figure 6:
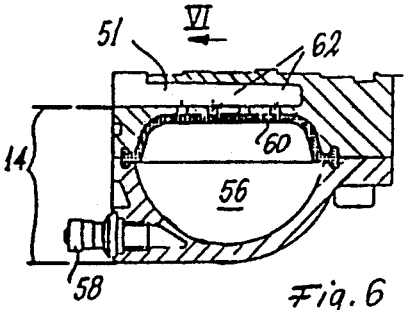
FIG. 6 is a sectional view following line VI—VI of FIG. 3.
Figure 5:
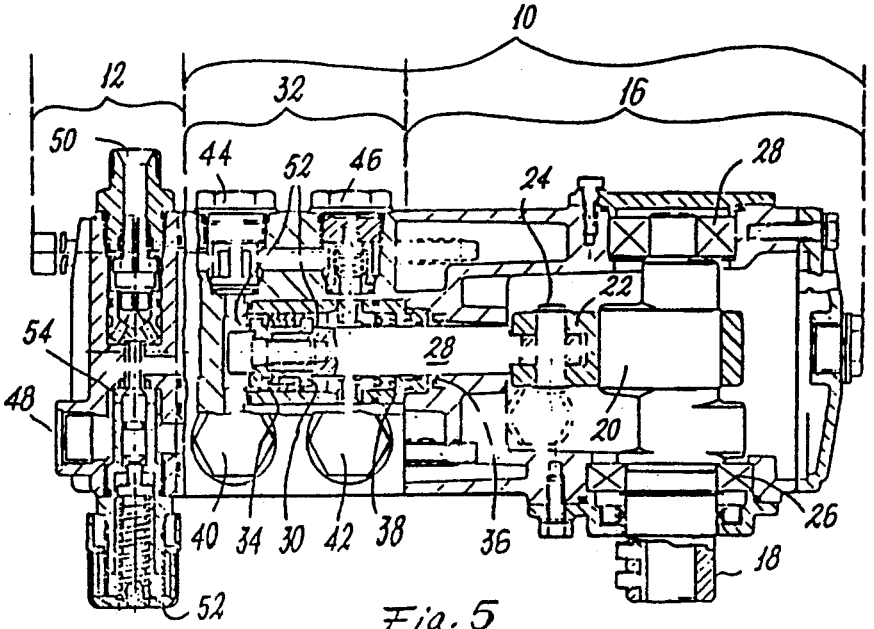
FIG. 5 is a sectional view following line V—V of FIG. 1.

On examining drawings, it can be seen that the pumping unit is made up by three fundamental parts: the pump itself 10, more clearly visible in FIG. 5; the control unit 12, more clearly visible in FIG. 5; and the pressure damping device 14, more visible in FIG. 6.

Starting to describe the pump 10 itself and referring above all to FIG. 5, a crankcase 16 can be sen. This contains the shaft 18 having only one cam 20. This shaft can be connected to the shaft of an electric motor (not shown) and is supported by the crankcase 16 through two bearings 26 and 28.

The connecting rod 22, rotating perpendicularly to the shaft 18, is connected to the shaft 18 itself on the cam 20. This connecting rod 22 is connected through the plunger pin 24 to one end of the plunger rod 28. At the other end of the plunger rod 28 is connected the double-acting plunger 30. The plunger rod 28 is therefore always coaxial and integral to the plunger 30. This plunger rod 28 is partly in the crankcase 16 and partly in the body 12 of the pump 10.

The plunger 30 is therefore located in the body 12 of the pump and is equipped with seals 34 that move together with it. Particularly, the plunger seals may be of the known type manufactured by Merkel Company.

The crankcase 16 is filled with oil and to obtain the seal, both a shaft seal 36 and a collet (bush) 38 with dynamic seal are necessary.

Furthermore, the body 32 of the pump contains two automatic valves 40 and 42 for suction and two automatic valves 44 and 46 for outlet.

The former link chamber 52 of the plunger 30 with suction 48 and the latter contains the same chamber 52 with the outlet 50. The outlet 50 is at the end of the control unit 12 which is included in the pumping unit so as to result as attached to the pump, although it is separate from it.

Therefore, there are no external connections between the pump and the control unit. The control unit is of a conventional type.

As already explained, its function is to deviate the flow from the outlet in case the water flow coming out of the lance needs to be varied.

Figure 1:
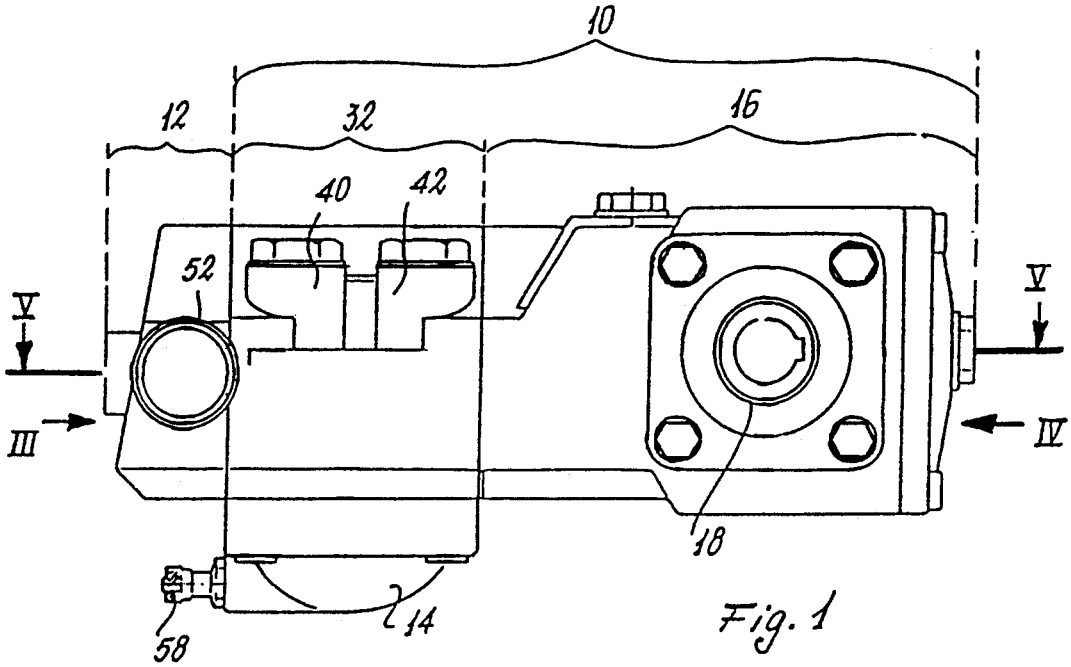
FIG. 1 is a side view of the pumping unit.
Figure 2:
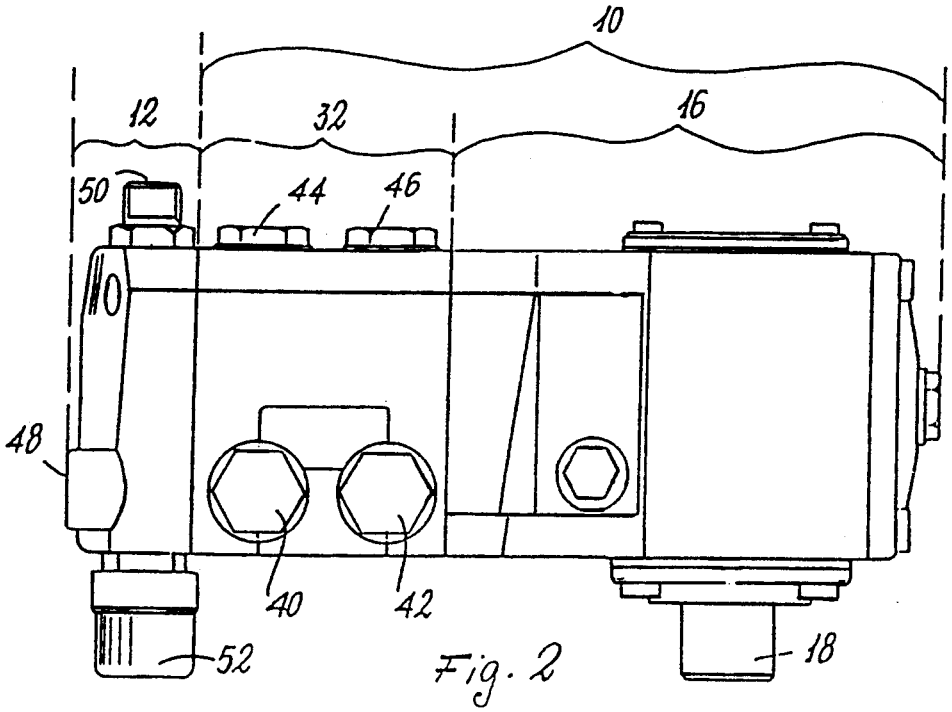
FIG. 2 is a top view.
Figure 3:
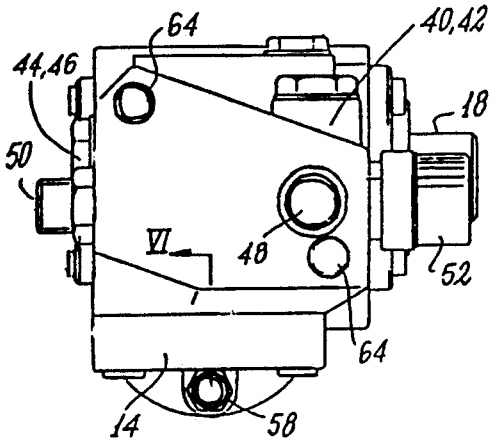
FIG. 3 is a view according to the arrow III of FIG. 1.
Figure 4:
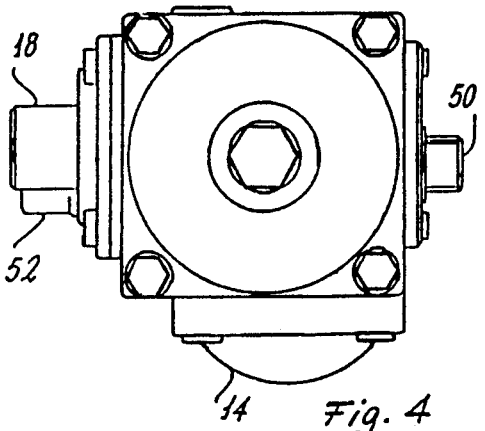
FIG. 4 is a view according to the arrow IV of FIG. 1.

As shown in FIG. 5, the control unit is composed by a double check valve choking the outlet 50 and connected to the return line 54. The regulation of the choke occurs through the handle 52. Particularly, the return line 54 is linked to the suction 48. Also, the pressure damping device 14 is of a conventional type. It is attached to the pump 10 (see FIGS. 3 and 6), although it is separate from it.

The pressure damping device 14 has no external connections. It consists of an air chamber 56 which is put under pressure (100–120 psi) through the air valve 58. On one side, the air chamber is closed with an elastic diaphragm 60 separating it from the chamber 51 which is linked to the outlet 50.

The outlet pressure peaks deform the elastic diaphragm 60 by compressing the air in chamber 56.

As already explained, all this produces an effect of damping and accumulation of pressure and energy. The attached drawings clearly show the compactness and the constructions and assembly simplicity of the pumping unit.

The three parts composing the pumping unit are kept together by two screws 64 only. All metal parts are obtained through an investment casing process. For this reason, the necessary mechanical machinings are really few.

We claim:

1. A pumping unit, comprising:

a pump having an axially reciprocating double-acting plunger for generating a pressurized flow of fluid between inlet and outlet means associated with opposite ends of said plunger;

a control unit connected to said outlet means for delivering output flow at a variable rate from said pump, said control having a passage connecting said inlet and outlet, said passage being choked by a double choking valve variably positioned therein by a spring-loaded handle, such that output flow can be deviated from said outlet means at a drastically reduced pressure to said inlet means for recirculation, whereby said pump works with no load and the output flow rate is infinitely variable between zero and the maximum flow rate of said pump; and a sealed pressure damping device in the fluid flow for damping pressure surges in the flow from said outlet means of said pump without leakage.

2. The device of claim 1 wherein said pump is of the hydraulic type for pumping liquids.

3. The device of claim 1 wherein said sealed damping device includes a first chamber fluidly connected to said pump outlets, a second chamber pressurized by compressed air from an external source, said first and second chambers having a common wall formed by a resilient imperforate diaphragm in sealed engagement with said chambers.

4. The device of claim 1 wherein said pump includes a single double-acting plunger.

5. The device of claim 1 wherein said pumping unit includes a single housing for holding said pump, said control unit and said sealed pressure damping device together as a single integrated pumping unit.

6. The integrated pumping unit of claim 5 wherein said pump, control unit and sealed pressure damping device are fluidly connected by internal passageways within said housing.

7. The integrated pumping unit of claim 5 wherein said pump, control unit and sealed pressure damping device are secured together in said pumping unit by only two screws.

* * * * *